US009816360B2

(12) United States Patent
Crow et al.

(10) Patent No.: US 9,816,360 B2
(45) Date of Patent: Nov. 14, 2017

(54) SUBTERRANEAN TOOL WITH SEALED ELECTRONIC PASSAGE ACROSS MULTIPLE SECTIONS

(71) Applicant: David L. Abney, Inc., Seagoville, TX (US)

(72) Inventors: Morgan Crow, Ovilla, TX (US); David Abney, Rowlett, TX (US)

(73) Assignee: David L. Abney, Inc., Seagoville, TX (US)

( * ) Notice: Subject to any disclaimer, the term of this patent is extended or adjusted under 35 U.S.C. 154(b) by 602 days.

(21) Appl. No.: 14/337,443

(22) Filed: Jul. 22, 2014

(65) Prior Publication Data

US 2014/0326445 A1 Nov. 6, 2014

Related U.S. Application Data

(62) Division of application No. 13/526,470, filed on Jun. 18, 2012, now Pat. No. 9,051,798.

(60) Provisional application No. 61/498,401, filed on Jun. 17, 2011, provisional application No. 61/605,457, filed on Mar. 1, 2012.

(51) Int. Cl.

| | |
|---|---|
| ***E21B 43/14*** | (2006.01) |
| ***E21B 34/06*** | (2006.01) |
| ***E21B 43/12*** | (2006.01) |
| ***E21B 17/02*** | (2006.01) |
| ***E21B 17/046*** | (2006.01) |

(52) U.S. Cl.

CPC ..... *E21B 43/14* (2013.01); *E21B 17/028* (2013.01); *E21B 17/046* (2013.01); *E21B 34/066* (2013.01); *E21B 43/128* (2013.01)

(58) Field of Classification Search

CPC ..... E21B 43/14; E21B 43/128; E21B 17/046; E21B 34/066; E21B 17/028

See application file for complete search history.

(56) References Cited

U.S. PATENT DOCUMENTS

| | | | |
|---|---|---|---|
| 2,618,339 | A | 11/1952 | Glover |
| 3,239,244 | A | 3/1966 | Leinfelt |
| 3,381,983 | A | 5/1968 | Hanes |

(Continued)

FOREIGN PATENT DOCUMENTS

| | | |
|---|---|---|
| EP | 0405951 A1 | 1/1991 |
| RU | 2385409 | 3/2010 |

(Continued)

*Primary Examiner* — Blake E Michener

(74) *Attorney, Agent, or Firm* — John G. Fischer, Esq.; Scheef & Stone, L.L.P.

(57) ABSTRACT

The invention relates generally to oil and gas exploration and production and, more particularly, to a system and associated method for producing hydrocarbons from multiple layers of subterranean formations, and the mixing or comingling of such hydrocarbons as necessary or desired during the production process. A subterranean tool is disclosed, having a plurality of tubular sections connected by a novel non-threaded linear connection system. An electrical passage can then be provided within the cylinder wall of contiguous sections permitting connection of electronics in different sections of the tool. Bushings and seals located in the electrical passage maintain an atmospheric pressure environment for electrical components inside the tool.

8 Claims, 9 Drawing Sheets

(56) References Cited

U.S. PATENT DOCUMENTS 3,430,181 A * 2/1969 Urbanosky ..... E21B 17/028 166/100
3,831,443 A * 8/1974 Planche ..... E21B 17/1021 137/614.05
4,293,148 A 10/1981 Milberger
4,498,874 A 2/1985 Pichl
4,697,947 A 10/1987 Bauer et al.
4,749,192 A 6/1988 Howeth
4,860,581 A * 8/1989 Zimmerman ..... E21B 49/081 175/50
4,927,192 A 5/1990 Ungchusri et al.
4,936,139 A * 6/1990 Zimmerman ..... E21B 49/08 175/40
5,131,692 A 7/1992 Lemons
5,303,773 A * 4/1994 Czernichow ..... E21B 47/011 166/242.6
5,383,694 A 1/1995 Taeuber et al.
5,388,926 A 2/1995 Stottlemyer
5,465,787 A 11/1995 Roth
5,513,151 A 4/1996 Morningstar et al.
5,823,263 A * 10/1998 Morris ..... E21B 23/002 166/191
5,944,109 A 8/1999 Longbottom
6,079,494 A 6/2000 Longbottom et al.
6,119,780 A 9/2000 Christmas
6,311,772 B1 11/2001 Myhre et al.
6,334,486 B1 1/2002 Carmody et al.
6,352,288 B1 3/2002 Calkins
6,494,264 B2 12/2002 Pringle et al.
6,561,277 B2 5/2003 Algeroy et al.
RE38,129 E * 6/2003 Kleinberg ..... G01N 33/2823 166/250.01
6,684,956 B1 2/2004 Berry
6,782,948 B2 8/2004 Echols et al.
6,786,285 B2 9/2004 Johnson et al.
6,832,515 B2 * 12/2004 Follini ..... E21B 47/10 166/100
7,086,471 B2 8/2006 Cantin et al.
7,213,655 B2 5/2007 Parrott
7,261,168 B2 * 8/2007 McGregor ..... E21B 49/10 166/100
7,370,705 B2 5/2008 Jones et al.
7,677,307 B2 * 3/2010 Vasques ..... E21B 37/00 166/250.01
7,726,396 B2 * 6/2010 Briquet ..... E21B 17/028 166/242.6
7,819,194 B2 10/2010 Tips
7,866,387 B2 * 1/2011 van Zuilekom .... E21B 33/1243 166/191
7,886,832 B2 2/2011 Partouche
7,913,774 B2 * 3/2011 Partouche ..... E21B 17/02 175/48
8,312,944 B2 11/2012 Marshall et al.
8,905,128 B2 * 12/2014 Niconoff ..... E21B 49/10 166/250.01
9,051,798 B2 * 6/2015 Crow ..... E21B 34/066
9,163,500 B2 * 10/2015 Tao ..... E21B 49/10
2001/0037883 A1 11/2001 Veneruso et al.
2002/0163190 A1 11/2002 Munk et al.
2004/0155462 A1 8/2004 Nguyen et al.
2005/0186823 A1 8/2005 Ring et al.
2008/0236828 A1 10/2008 Fuhst et al.
2009/0025926 A1 1/2009 Briquet et al.
2009/0097926 A1 4/2009 Paulsen
2010/0126729 A1 5/2010 Tunget
2010/0164223 A1 7/2010 Curtiss, III et al.
2013/0093183 A1 4/2013 Guidry et al.

FOREIGN PATENT DOCUMENTS

RU 102675 U1 10/2011
RU 2438046 C1 12/2011
WO 2011/011612 A2 1/2011

* cited by examiner

SUBTERRANEAN TOOL WITH SEALED ELECTRONIC PASSAGE ACROSS MULTIPLE SECTIONS

TECHNICAL FIELD

The invention relates generally to oil and gas exploration and production and, more particularly, to a system and associated method for producing hydrocarbons from multiple layers of subterranean formations, and the mixing or comingling of such hydrocarbons as necessary or desired during the production process. The invention further relates to non-rotatable connections and environmentally contained systems of chambers and passages in subterranean tools.

BACKGROUND

In a commonly encountered downhole scenario, it is desirable to have the capability to produce two different hydrocarbons or other varieties of production fluids from two different strata from a single submersible pump. To accomplish this, it is necessary to mix, or comingle the fluids. It may also be required to limit such comingling of the production zones. This may occur as a result of ownership rights or regulations or laws governing the production of such hydrocarbons and other regulations that further regulate the mixing or comingling of such fluids from multiple strata.

Therefore, it may be desired to be able to regulate the flow rate of production fluids when simultaneously producing from two or more strata. As a result, various methods for regulating the flow of fluids down hole have been developed in the past, such as valves and chokes. However, such previous methods have been unable to effectively control the mixing or comingling of fluids from two strata to provide accurate, repeatable, and controlled mixing or have been unable to do so without expensive and cumbersome equipment prone to failure.

For instance, a downhole valve may be configured while at the surface of the well to permit a certain flow rate for the comingling of two fluids down hole. The valve may then be installed into the wellbore for the regulation of fluid flow. However, as production commences, downhole conditions may subsequently change due to changes in reservoir pressure, temperature, fluid viscosity, etc. As a result, the downhole valve may need to be brought back to the surface for reconfiguration. Such necessary reconfiguration is expensive, tedious, and time consuming. As a result, each time the valve may need to be reconfigured will cause significant delays and expenses to the well operator.

Alternatively, it has been conventional to utilize two separate sets of tubing in parallel in the wellbore to simultaneously produce hydrocarbons and other desired fluids from two or more different strata. The two sets of tubing in parallel may be connected to the two different desired strata and therefore two separate zones or reservoirs could be simultaneously produced with a single pumping mechanism. However, this method is cumbersome in that two separate tubings are necessary to run down the wellbore. In order to utilize two tubings simultaneously, the wellbore must be appropriately sized at a large enough diameter to accommodate both sets of tubing at the same time. This leads to additional costs during the drilling process.

Conventional tools are not commercially practical due in a large part to the inability to effectively connect the power source to electronic sensors and circuit boards housed in controlled pressure environments. This is due to the need to construct tools in multiple sections and the long-standing convention connecting tubular sections together with threaded connections. The rotating connections prevent the creation of a continuous electronic passage, and in particular, the creation of a passageway and interconnected chambers for housing the sensitive electronic components in which the pressure of the passage and chambers is controlled contrary to the subterranean pressures experienced by the tool when in use.

Thus, a significant challenge to providing such controls down hole is the extreme pressure and temperature near the bottom of the producing well, and the impact on these environmental conditions on computer processing electronics.

Another significant challenge to providing such controls down hole is the need to connect electronics across sections of the tool that must be coupled together. This requirement prevents the use of threaded couplings, such as are the norm in drilling and production connections.

Therefore, there is a need for a tool having the capability of providing surface controllable electronic controls for controlling the valve or choke to control the desired comingling of fluids from two different strata in an efficient and cost effective manner, and there is a further need for a downhole valve or choke that can be controlled by a well operator directly from the surface, without retrieving and reinserting the valve or choke.

SUMMARY

The present invention addresses the deficiencies in the prior art by allowing better management of the process for producing hydrocarbons from multiple strata. One example is described herein through an exemplary embodiment of the present invention which allows a well operator to control a downhole choke or valve to regulate the flow of production fluid from a lower strata to an upper strata. Another example is described hereunder where the present invention may suitably determine the appropriate position of the valve through a plurality of downhole sensors.

The bottom end of the tool is mounted to a hydraulic set packer located between an upper production zone and a lower production zone. The upper end of the tool is connected to the submersible pump. When the valve is closed, production will be limited to the upper zone. When the valve is opened, the lower zone fluid will enter the bottom of the tool and exit the valve on the side of the tool where it comingles with the upper zone fluid. In the present invention, the flow rate of the lower zone fluid is measurable and controllable. The comingling and production of two or more zones is accomplished in a smaller form factor than has been previously known. Rather, the present invention may produce hydrocarbons and other desired fluids from multiple downhole strata through the use of a single set of tubing, through the use of a motorized valve controlled by a downhole computer.

The downhole computer in turn may be electronically connected to the surface of the well such that a well operator may preferably receive feedback on the downhole well conditions through a plurality of sensors located on the tool, as well as send appropriate control information to make further adjustments to the valve. Such feedback on the downhole conditions may include information on the current fluid flow rate, amount of water, downstream pressure, volume, rate of pressure change, etc.

Thus, as the well production continues and encounters variously changing downhole conditions, the well operator may receive immediate updates on the current downhole conditions. The present invention further eliminates the need to retrieve the valve and adjacent downhole equipment, make the necessary adjustments, and return the valve to the wellbore before continuing production from a different strata in a multiple zone well. Furthermore, the present invention allows for the simultaneous production of multiple strata, thereby eliminating the necessity of sequential production of various strata, one at a time.

These and other features, advantages, benefits and objects of the present invention will become apparent to one of ordinary skill in the art upon careful consideration of the detailed description of representative embodiments of the invention herein below and the accompanying drawings.

The present invention provides a subterranean production tool, having a first section and a second section connectable at respective connecting ends. One of the first and second sections has a male flange at its connecting end with a substantially circular exterior. There is a first circumferential groove extending over at least a portion of the exterior. The other of the first and second sections has a female flange at its connecting end with a substantially circular interior. A second circumferential groove extends over a portion of the interior. A keyway is formed between the first and second grooves when the female flange is positioned over the male flange in aligned relationship. An access relief is located on an exterior surface of the female flange forming a passage to the keyway. A plurality of keys are provided for inserting through the access relief to enter into the keyway to prevent separation of the first section and the second section.

In another embodiment, the first and second sections have a generally hollow tubular body with a cylindrical wall. A first electrical passage is located within the cylinder wall of the first section in lengthwise orientation. A second electrical passage is located within the cylinder wall of the second section in lengthwise orientation. The first and second passages are aligned to form a continuous passage between the first section and the second section.

In another embodiment, the first and second passages are sealed so as to maintain an atmospheric pressure when the tool is operating in a subterranean environment.

In another embodiment, an ungrooved portion remains on the interior of the female flange. In another embodiment, the keys have a curved interior surface and a curved exterior surface, with the interior and exterior surfaces being substantially parallel. The keys have opposing end surfaces that are unparallel with respect to each other.

In another embodiment, the keyway holds between 8 and 11 keys.

A fastener hole is provided on an exterior surface of the second section that passes through to the second groove. A key has a threaded center. A fastener is locatable in the fastener hole and connectable into the threaded center of the key to lock the key in position in the keyway.

In another embodiment, a dowel pin is positioned axially between the first section and the second section. The dowel provides alignment between the first section and the second sections such that the first and second grooves form the keyway. The dowel prevents relative rotation between the first section and the second section when the male flange is positioned inside the female flange.

In another embodiment, a threaded aperture extends through the female flange at a location non-intersecting with the second groove. A receiving groove circumscribes the exterior surface of the male flange. A fastener is connected to the threaded aperture such that it intersects the receiving groove. The fastener can be a set screw that biases the load between the first and second sections such that the keys support the tension load between the first and second sections.

In another embodiment, the first and second sections are substantially hollow tubulars. In another embodiment, at least one of the first and second sections has a length at least 10 times an outer diameter of the respective section.

In another embodiment, the first and second sections have a hollow tubular body with a cylindrical wall. A first electrical passage is located within the cylinder wall of the first section in lengthwise orientation A second electrical passage is located within the cylinder wall of the second section in lengthwise orientation. The first and second passages are aligned to form a continuous passage between the first section and the second section. The electrical passage passes through an ungrooved portion of the female flange.

In another embodiment, a spool seal is provided at the juncture of the passages. In this manner, the connections between the first and second passages and the tool are sealed to maintain an atmospheric pressure within the electronic passages when the tool is operating in a subterranean environment. Electrical wiring inside the passage connects electrical components in the first section with electrical components in the second section.

In another embodiment, the electrical passage passes through an ungrooved portion of the female flange. In another embodiment, the first section and the second section further comprise a circuit board having a processor, and an electric motor, electrically connected to the circuit board. A gearbox is connected to the motor, and a shaft extends from the gearbox. A rotatable valve is connected to the shaft.

In another embodiment, a harmonic drive is connected to the gearbox to further reduce the speed of the shaft and increase the torque. In another embodiment, a pressure sensor is provided. An analog to digital converter is electrically connected to the sensor, and electrically connected to the circuit board.

In another embodiment, a data wire is located inside the first and second passages. A condition monitoring instrument is located inside the second section, electrically connected to the data wire through the second portal. The condition monitoring instrument may be a resolver connected to the shaft. The resolver is electrically connected to the circuit board such that the position of the valve can be determined.

In another embodiment, a tool having a hollow tubular body and having a cylindrical wall is provided. The body is comprised of a plurality of sections connected by non-threaded linear connections. An electrical passage is located within the cylinder wall of contiguous sections, located in lengthwise orientation. A seal is located in the electrical passage at a juncture between contiguous sections. Inside the tool sections is a circuit board having a computer processor; an electric motor electrically connected to the circuit board, a gearbox connected to the motor, and a shaft extending from the gearbox.

The tool has an inlet orifice at one end for receiving a lower zone production fluid into the tool. An outlet port perforates the cylindrical wall of the tubular body. A rotatable valve is connected to the shaft, and has a vented portal. The valve is controllably rotatable between an open position, in which the vented portal is aligned with the outlet port and fluid inside the tool may flow through the outlet, and a closed position, in which the vented portal is not aligned with the outlet and flow through the outlet is blocked.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Figure 1:
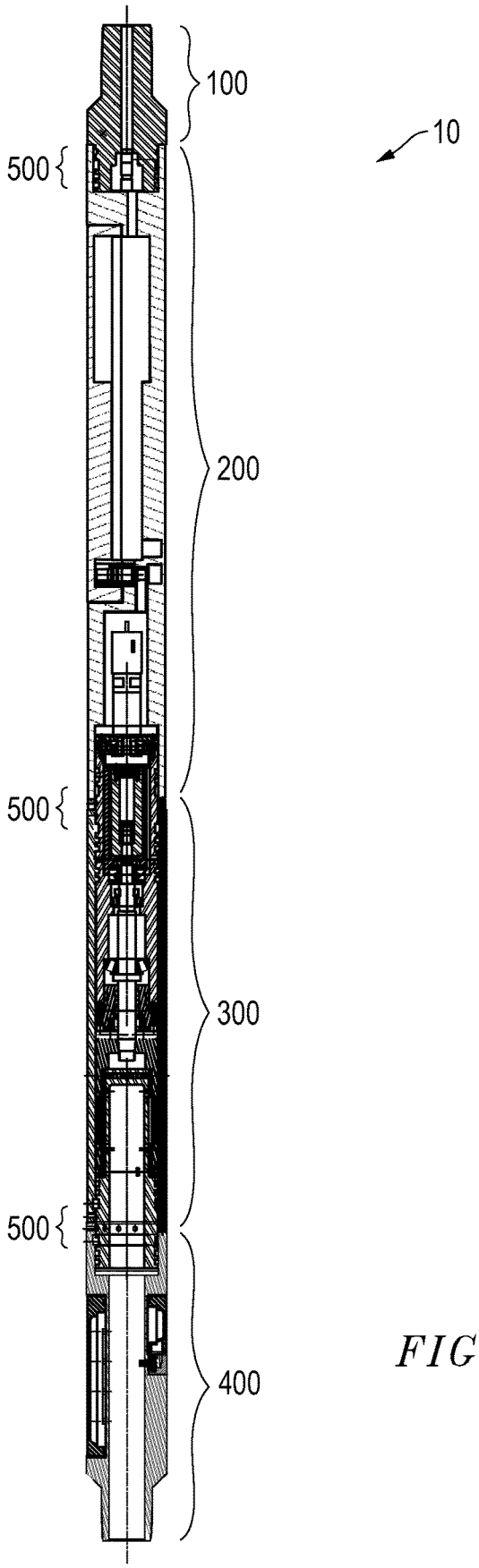
FIG. 1 is a cross-sectional view of a subterranean production tool embodying features of the present invention, and specially configured as a reservoir comingling tool.

FIG. 1 is a cross-sectional view of a subterranean production tool 10 embodying features of the present invention, and specially configured as a reservoir comingling tool. Tool 10 may comprise several sections. In the embodiment illustrated, tool 10 comprises a top sub 100, a computer section 200, a valve assembly 300, and a sensor assembly 400.

The names of the sections and assemblies are merely for convenience and not intended to completely describe, require, or limit the contents of any section of tool 10, and as used here, do not. It is known that the beginnings and ends of the sections may be located to include or exclude certain equipment. It is also known that certain teachings of the present invention can be applied to other subterranean tools besides a comingler.

Top sub 100 may be connected to computer section 200 by means of a non-threaded, and non-rotated connection 500. Connection 500 may be described as a linear key-slot connection 500. Such connections 500 are not known to have been used previously in the connection of tubulars for subterranean production. Computer section 200 is connected to valve assembly 300 by key-slot connection 500. Similarly, valve assembly 300 is connected to sensor assembly 400 by key-slot connection 500.

Figure 2:
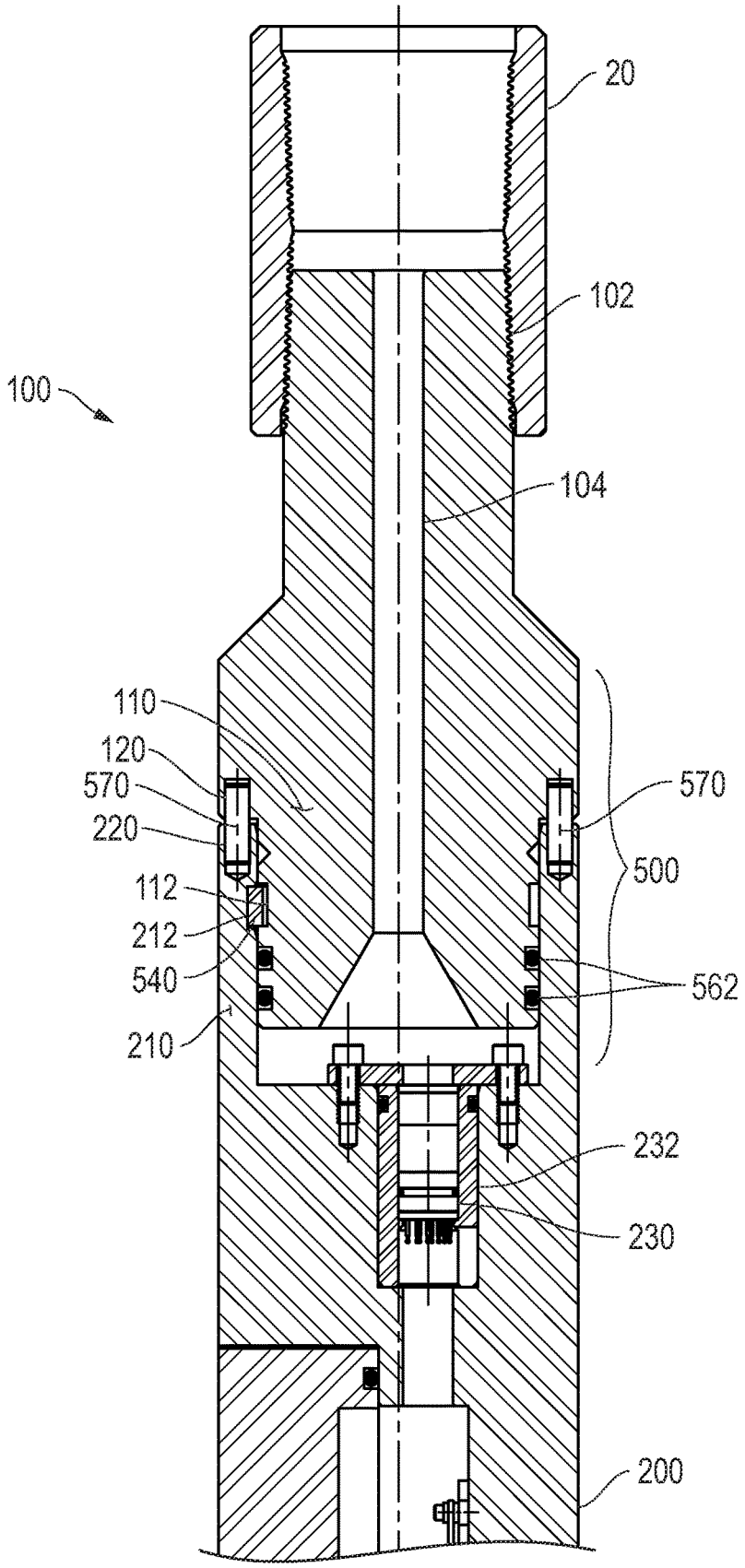
FIG. 2 is a cross-sectional side view of a top sub section of the comingling tool of FIG. 1.

FIG. 2 is a cross-sectional view of top sub 100 of tool 10 of FIG. 1. Top sub 100 comprises a tubular having a threaded pin connection 102 for connection to a production string component 20, such as a submersible pump. Top sub 100 has a hollow center 104.

An electrical connector 230 is sealed in place inside hollow center 104 of top sub 100 by a bushing 232. In this manner, electrical connections can be passed between the interior of computer section 200 and top sub 100 for connection to a power source, such as an electrical submersible pump, without passing environmental conditions and contaminants past bushing 232.

The lower end of top sub 100 has a male connector flange 110 having a circular exterior. A first groove 112 extends circumferentially over the circular exterior of male connector 110. In an optional embodiment, first groove 112 does not extend over the full circumference of the exterior surface male connection 110.

Computer section 200 has a female connector 210 having a circular interior locatable over male connector 110 of top sub 100. A second groove 212 extends circumferentially over a portion of the female connector interior. In the preferred embodiment, second groove 212 does not extend over the full circumference of the interior surface of female connector 210.

In the embodiment illustrated, top sub 100 includes one or more dowel holes 120 for receiving a portion of a dowel 570. Computer section 200 includes one or more dowel holes 220 for receiving the opposite portion of dowel 570. Dowel 570 serves to align top sub 100 with computer section 200 so that first groove 112 and second groove 212 are in matching alignment. In matching alignment, first groove 112 and second groove 212 form a keyway 516.

Figure 3:
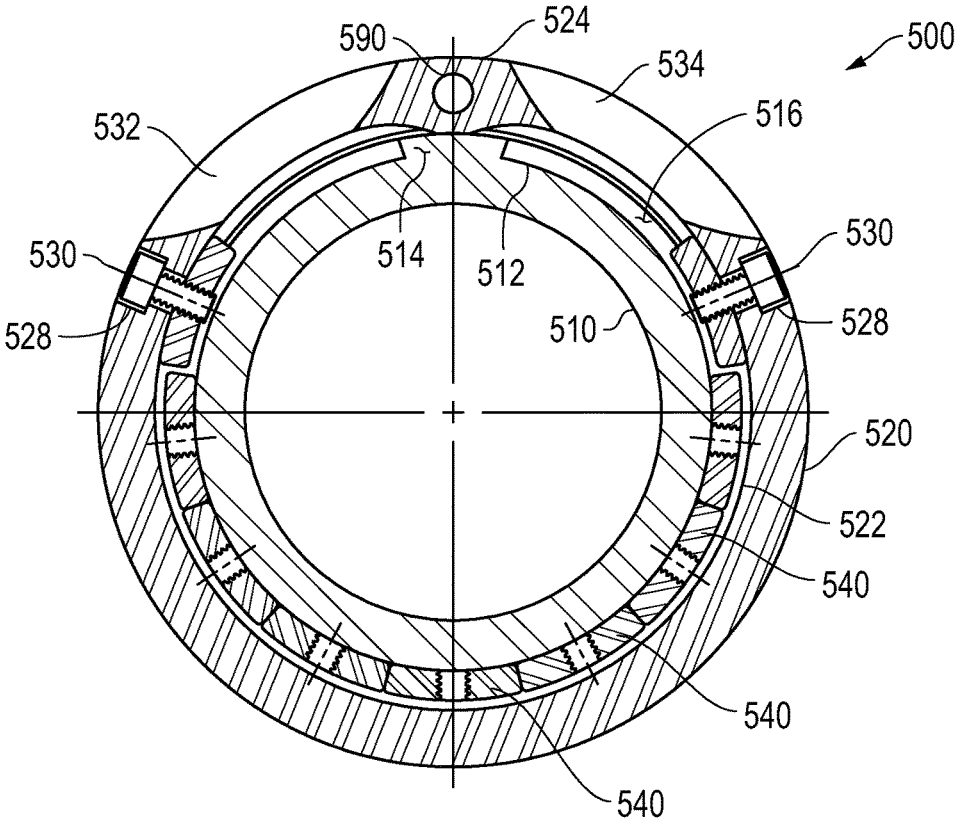
FIG. 3 is a cross-sectional end view of a non-threaded, non-rotatable key-slot coupling system of the present invention, as illustrated on the tool of FIG. 1, for non-rotated coupling of tool sections.

FIG. 3 is a cross-sectional view of a non-threaded, non-rotatable key-slot coupling system that is suitable for use with tool 10. As best seen in this cross section, a male connector 510 has a circular exterior. A first groove 512 extends circumferentially over a portion or all of the circular exterior of male connector 510. Optionally, first groove 512 does not extend over the full circumference of the exterior surface male connection 510, and an ungrooved portion 514 remains.

A female connector 520 has a circular interior, and is locatable over male connector 510. A second groove 522 extends circumferentially over a portion of the interior of female connector 520. Second groove 522 does not extend over the full circumference of the interior surface of female connector 520. An ungrooved portion 524 is provided. An electrical passage 590 extends laterally through ungrooved portion 524 of female connector 520.

Figure 4:
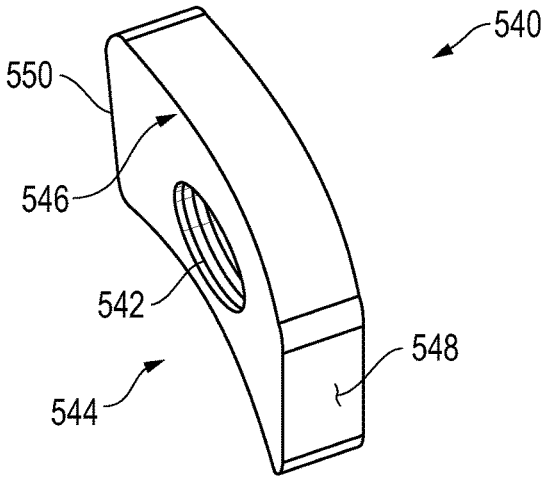
FIG. 4 is an isometric view of a key, as used in the key-slot coupling system of FIG. 3.
Figure 8:
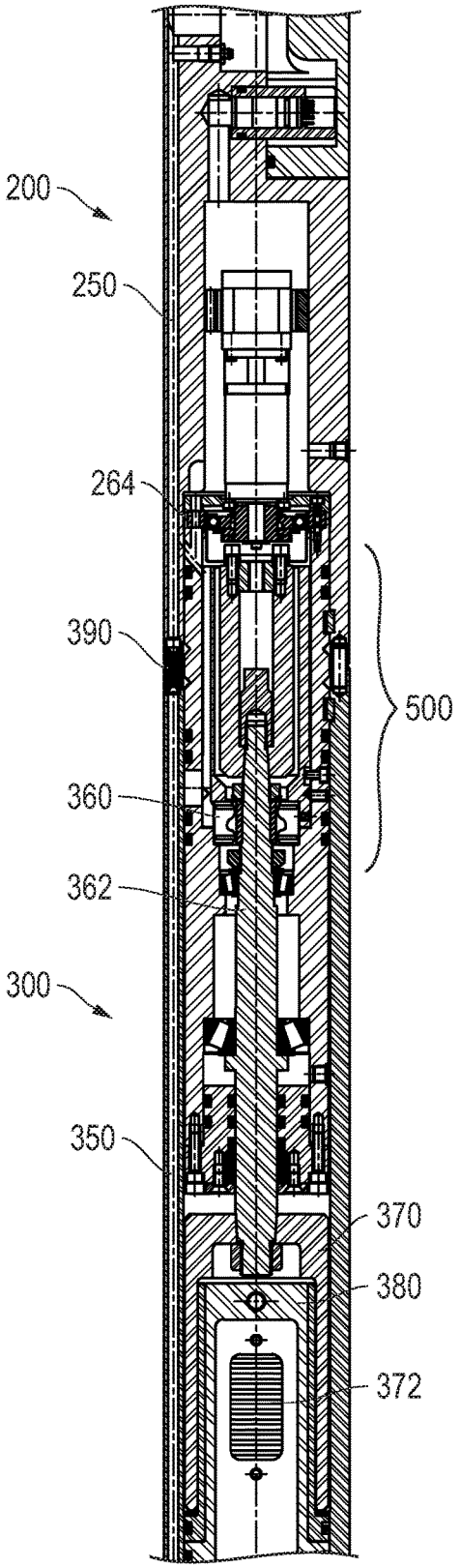
FIGS. 8 and 9 are cross-sectional side views of a valve section of the comingling tool of FIG. 1, with FIG. 9 illustrating the tool rotated 90 degrees from the orientation illustrated in FIG. 8.

FIG. 4 is an isometric view of key 540, as used in coupling assembly 500 of the present invention, and as illustrated in FIG. 8. As seen in FIG. 4, key 540 may have a threaded hole 542 through it. Key 540 has a curved outer surface 546 and a curved inner surface 544.

Key 540 has a curved inner surface 544 for sliding relationship with external groove 512 of male flange 510. Key 540 has a curved outer surface 546 designed for sliding relationship with inner groove 522 of female flange 520. Outer surface 546 and inner surface 544 are parallel. Key 540 has a pair of opposing end surfaces 548 and 550. In the preferred embodiment, end surfaces 548 and 550 are not parallel.

Figure 5:
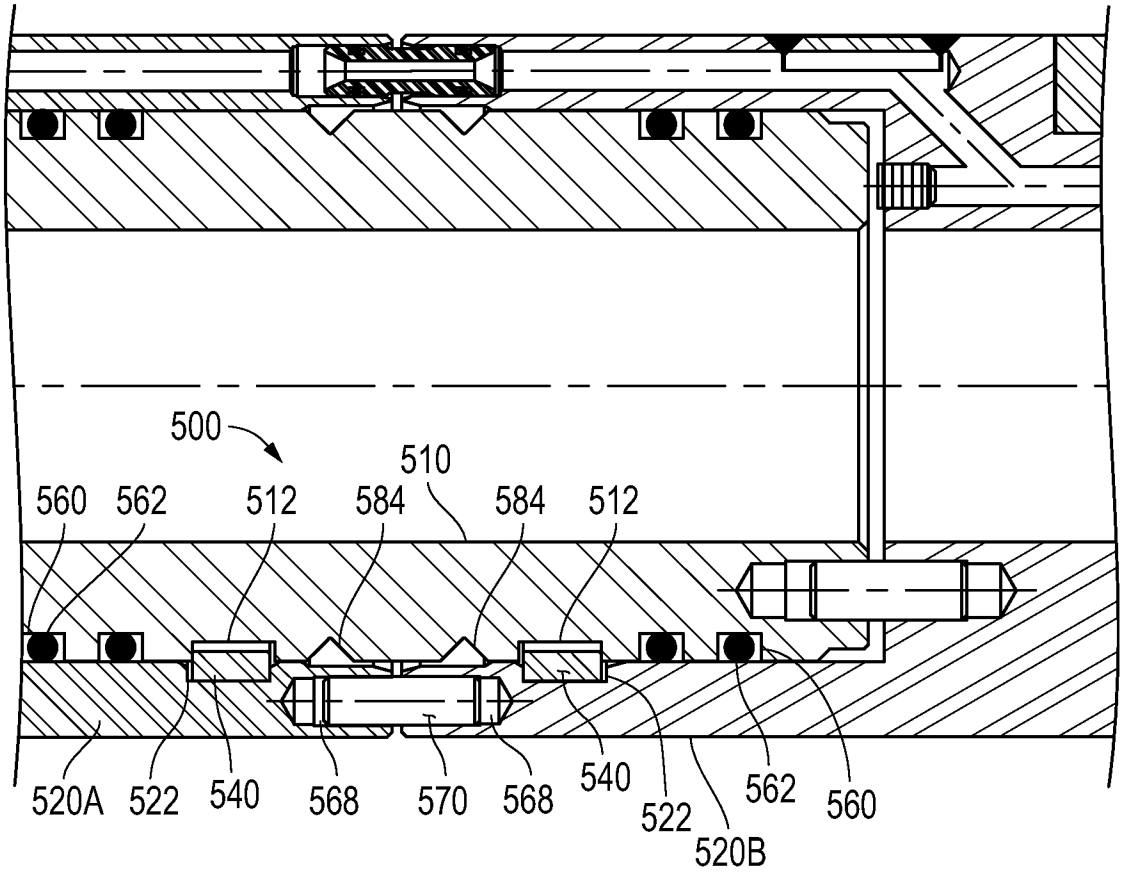
FIG. 5 is a cross-sectional side view of one embodiment of the key-slot coupling system of the present invention.

Referring to FIG. 5, complementary dowel slots 568 are provided in male connector 510 and female connector 520. When male connector 510 is located inside female connector 520, dowels 570 are located in slots 568 to provide alignment such that first groove 512 and second groove 522 align to form a keyway 516.

Referring back to FIG. 3, a first surface access relief 532 is provided on the surface of female connector 520 to provide passage to keyway 516. A plurality of keys 540 is insertable through access relief 532 for sliding fit in keyway 516. Optionally, a second surface access relief 534 is provided. Second access relief allows entry of a tool to push keys 540 out through first access relief 532, and vice-versa, for disassembly of tool 10.

A fastener hole 528 is provided on female connector 520 for receiving a fastener 530. One or more keys 540 has a threaded hole 542 for receiving fastener 530 in threaded engagement. Connection of fastener 530 to key 540 locks key 540 in position inside keyway 516. In this manner, male connector 510 of a first section of tool 10, and female connector 520 of a second section of tool 10 are locked in engagement, without the use of a conventional threaded connection. Dowels 570 resist relative rotation between male connector 510 of a first section of tool 10, and female connector 520 of a second section of tool 10. Keys 540 prevent lateral separation of male connector 510 of a first section of tool 10, and female connector 520 of a second section of tool 10.

A second fastener hole 528 can also be provided on the opposite side of ungrooved portion 524. Locating a second fastener hole 528 creates a stop for the remaining keys 540 to stack against. Alternatively, ungrooved portion 514 and/or ungrooved portion 524 may be used as an end-stop when inserting keys 540.

FIG. 5 is a cross-sectional side view of one embodiment of key-slot coupling system 500 illustrated in which a single male flange 510 is used to couple female flanges 520A and 520B of adjacent tubular sections of tool 10. As illustrated, seals 562 are located in seal grooves 560 to create a sealed relationship between male flange 510 and female flanges 520A and 520B. Also as shown, a dowel 570 can be located in matching dowel holes 568 between female flanges 520A and 520B as well as between male flange 510 and female flange 520. Receiving grooves 584 are shown on male flange 510 for receiving set screws 582 through threaded holes 580 (see example in FIG. 9) in female flanges 520A and 520B.

Figure 6:
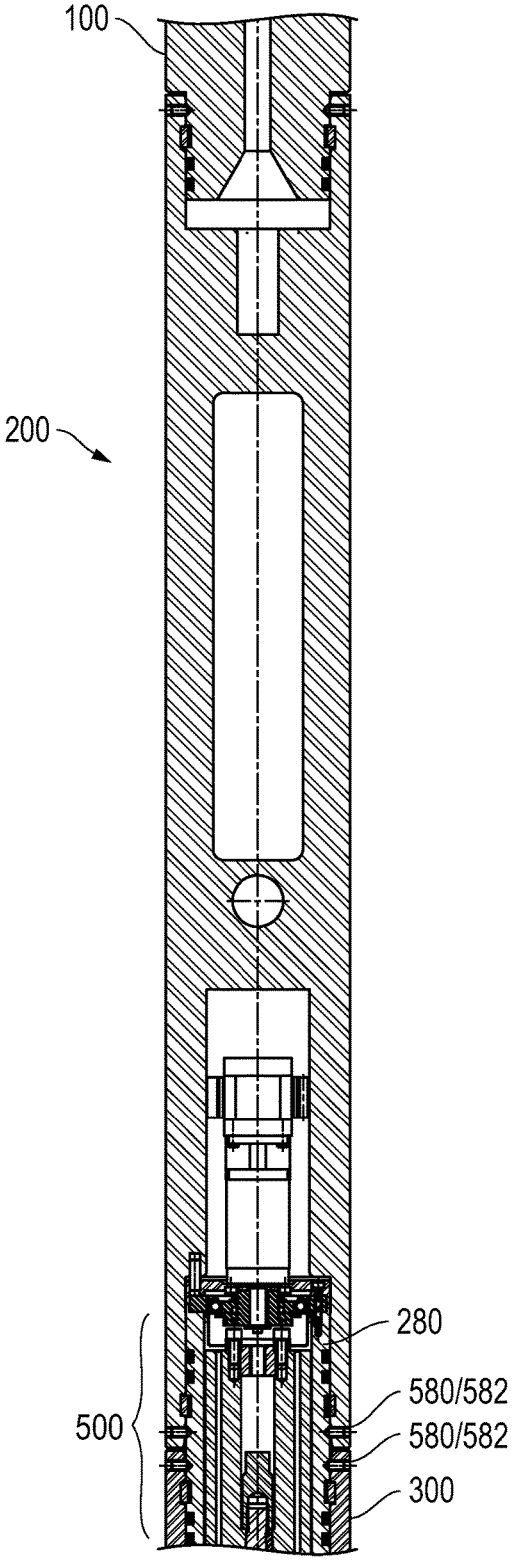
FIGS. 6 and 7 are cross-sectional views of a computer section of the comingling tool of FIG. 1, with FIG. 7 illustrating the tool rotated 90 degrees from the orientation illustrated in FIG. 6.
Figure 7:
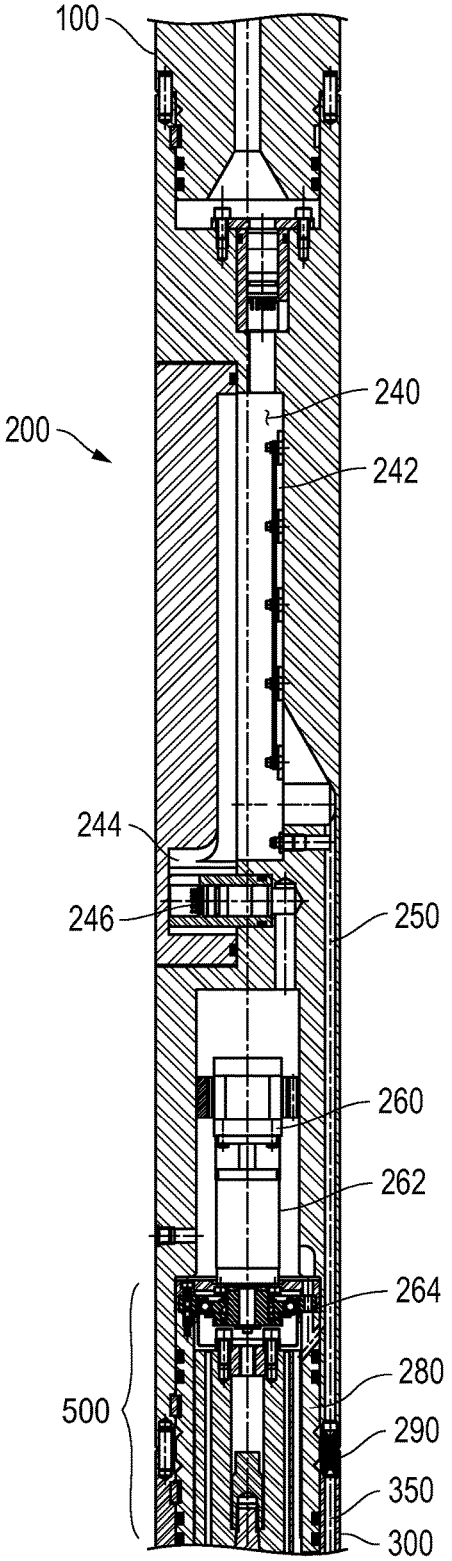

FIGS. 6 and 7 are cross-sectional views of computer section 200 of tool 10. As seen in FIG. 3, computer section 200 is connected to valve assembly 300 by key-slot connection system 500. In the embodiment illustrated, computer section 200 and valve assembly 300 are joined together over a gear insert 280. Gear insert 280 provides the male connector for each key-slot connection 500 to which computer section 200 and valve assembly 300 are connected.

As seen in FIG. 6, a threaded hole 580 is located through the female connector of computer section 200. The male connector of gear insert 280 has a receiving groove 584 (see FIG. 5) for receiving the tip of a set screw 582 located in threaded hole 580. Another threaded hole 580 is located in the female connector of valve assembly 300 over the male connector of gear insert 280 for receiving a set screw 582 for engagement with a second receiving groove 584 on the male connector of gear insert 280. Optionally, a drill point may be used in place of receiving groove 584.

FIG. 7 illustrates tool 10 rotated 90degrees from the orientation illustrated in FIG. 3. Computer section 200 has a chamber 240 for housing a circuit board 242. As used herein, circuit board 242 includes a computer or processor or other electrical system device for controlling tool 10.

Circuit board 242 is electrically connected to electrical connector 230 by electrical wiring (not shown). Bushing 232 seals electrical connector 230 to maintain an atmospheric pressure inside chamber 240 for the protection of circuit board 242. An electrical passage 244 intersects the lower end of chamber 240. A longitudinal electrical passage 250 also intersects chamber 240. Electrical passage 250 is located near the outer diameter of tubular computer section 200 and runs substantially parallel to the centerline of computer section 200.

A motor 260 is located inside computer section 200. Motor 260 is electrically connected to circuit board 242 through electrical passage 244. An electrical connector 246 may be located between circuit board 242 and motor 260. Electrical connector 246 may be sealed to computer section 200 to maintain the atmospheric (or near atmospheric) pressure condition inside chamber 240. A gearbox 262 is connected to motor 260. Gearbox 262 converts the speed of motor 260 into torque. A harmonic drive 264 may be connected to gear box 262 to further convert the speed of motor 260 into torque.

An electrical passage 350 is located near the outer diameter of tubular valve section 300. Electrical passage 350 is aligned with electrical passage 250 to form a continuous electrical passage for electrical connection of devices in valve section 300 with circuit board 242. A spool seal 290 provides sealed connection of electrical passage 250 to electrical passage 350.

Figure 9:
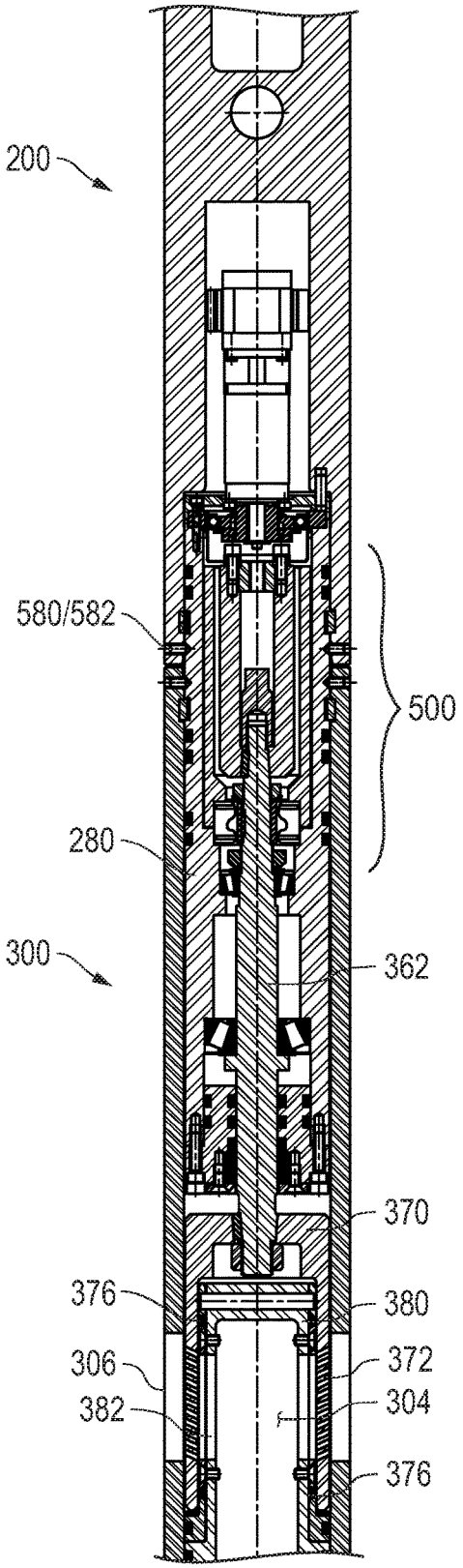

FIGS. 8 and 9 are cross-sectional side views of valve section 300 of tool 10. FIG. 9 illustrates tool 10 rotated 90 degrees from the orientation illustrated in FIG. 8. Referring to FIG. 8, a shaft 362 is connected to harmonic drive 264. The opposite end of shaft 362 is connected to a rotatable valve 370. Rotatable valve 370 has a vented opening 372. Valve 370 rotates over a stationary valve body 380 that has a body opening 382 leading to valve interior 304. A seal 376 surrounds body opening 382. Valve assembly 300 has an outlet port 306 connecting the exterior of tool 10 with the interior valve assembly 300 when valve 370 is open. Valve 370 is opened by aligning vented opening 372 between outlet port 306 and valve body opening 382.

A resolver 360 is positioned over shaft 362. Resolver 360 is electrically connected to circuit board 242 through electrical passage 350 and electrical passage 250. Resolver 360 is a condition monitoring device, used to determine the position of shaft 362 and thus the position of valve 370. Resolver 360 communicates this information along data wires electrically connected to circuit board 242.

A computer or processor on circuit board 242 can be used to control the amount that valve 370 is opened as well as the opening and closing of valve 370. Advantageous to the present invention is the ability to open valve 370 in any partially rotated amount. This gives tool 10 the ability to fully control the amount of fluid flow from the lower reservoir that is comingling with the production of the upper reservoir.

Figure 10:
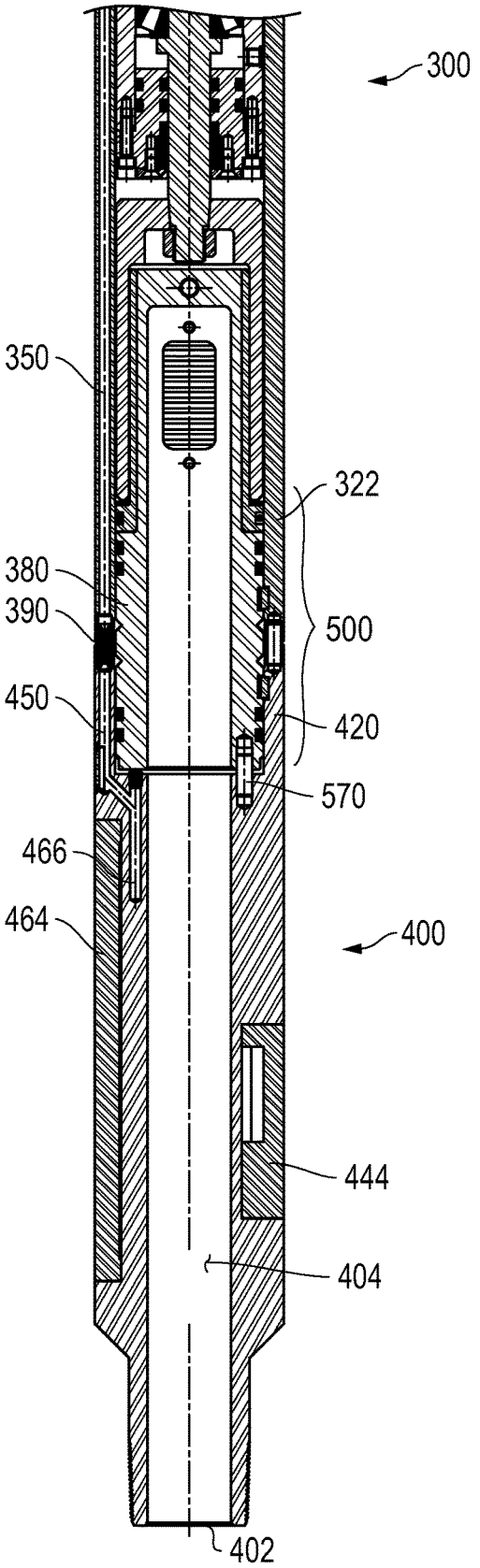
FIG. 10 is a cross-sectional side view of a sensor section of the comingling tool of FIG. 1.

FIG. 10 is a cross-sectional side view of sensor section 400 of tool 10. Sensor section 400 is connected to valve section 300 by key-slot connection system 500. An electrical passage 450 is located near the outer diameter of tubular sensor section 400. Electrical passage 450 is aligned with electrical passage 350 to form a continuous electrical passage for electrical connection of devices in sensor section 400 with circuit board 242.

Figure 11:
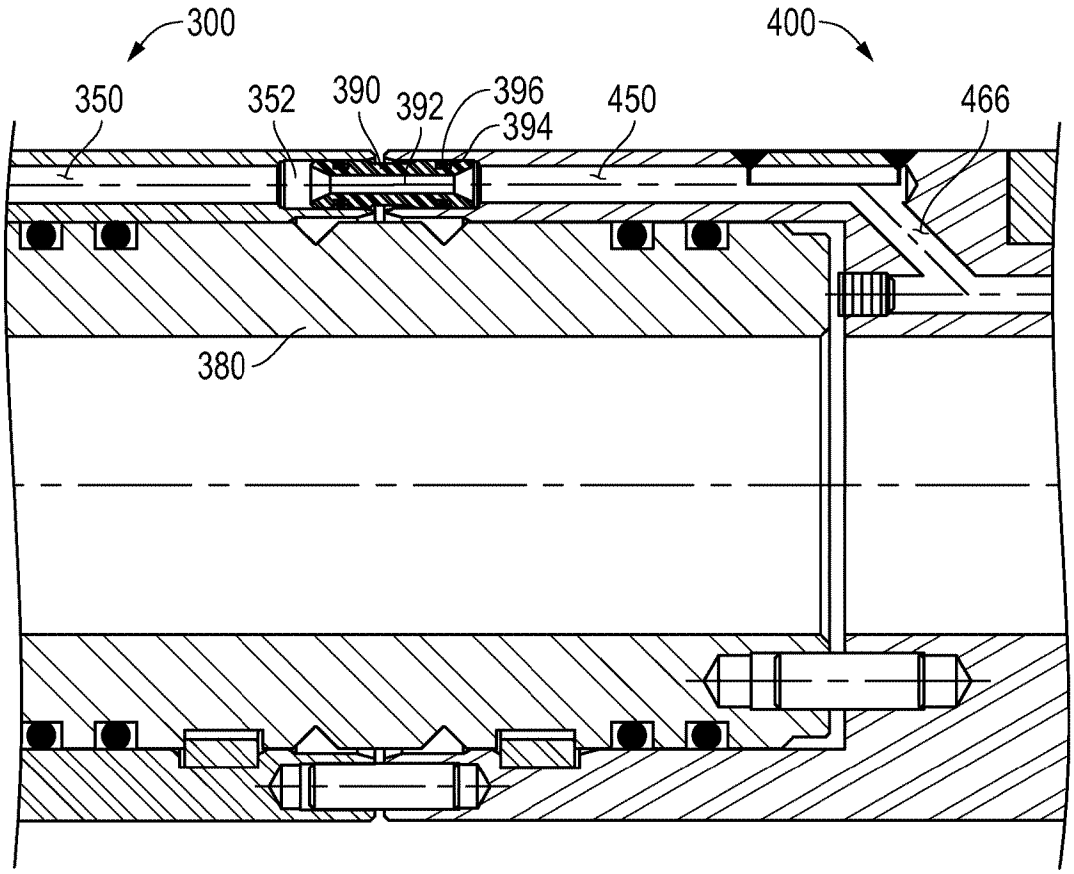
FIG. 11 is a cross-sectional side view of the coupling of the sensor section to the valve section of the tool, illustrating the sealed coupling of the electrical passageway.

FIG. 11 is a cross-sectional side view of the connection between valve section 300 and sensor section 400, illustrating the continuous sealed coupling of electrical passages 350 and 450. In this embodiment, a spool bore 352 is provided at the end of each electrical passage 350 and 450. A spool seal 390 is inserted in spool bores 352. Spool seal 390 has an internal bore 392, a seal groove 394 on each end, and a spool o-ring 396 is located in each seal groove 394. Spool o-rings 396 seal spool seal 390 to each of electrical passages 350 and 450 to provide a sealed connection of electrical passage 350 to electrical passage 450. As a result, the environmental conditions inside electrical passage 450 are controlled to be the same as for chamber 240.

Figure 12:
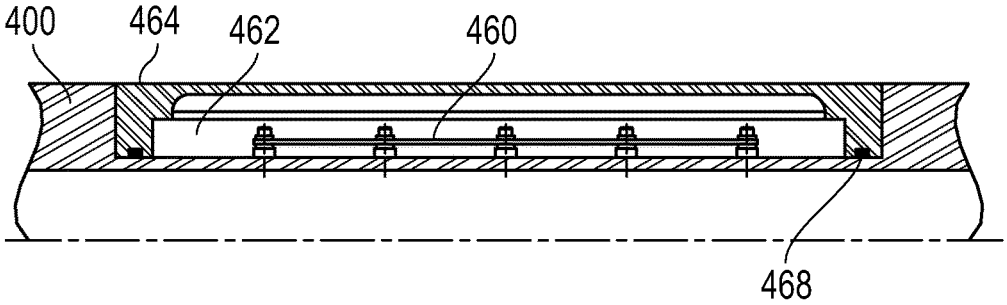
FIG. 12 is a side cross-sectional view of the Analog to Digital chamber of the sensor section of the tool.

FIG. 12 is a side cross-sectional view of the analog to digital chamber of sensor section 400 of tool 10. An analog to digital board 460 is located inside chamber 462. Chamber 462 has a cover 464 that is sealed by seal 468, thereby providing an environmentally protective enclosure for chamber 462. An electrical passage 466 (see FIG. 10) connects electrical passage 450 to sensor board chamber 462 located beneath cover 464.

Figure 13:
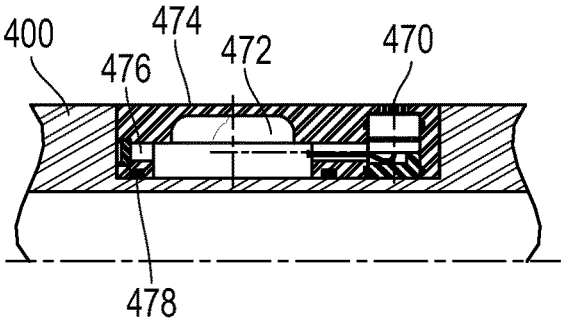
FIG. 13 is a side cross-sectional view of the casing sensor chamber of the sensor section of the tool.

FIG. 13 is a side cross-sectional view of a casing sensor chamber 472 of sensor section 400 of tool 10. A casing sensor 470 is located inside sensor chamber 472, in communication with annulus between the production casing and tool 10. In this position, casing sensor 470 can measure environmental conditions such as pressure of the production zone flow outside of tool 10. Chamber 472 has a cover 474 that is sealed by seal 478, thereby providing an environmentally protective enclosure of chamber 472. An electrical passage 476 connects chamber 470 with chamber 462 to provide a path for electrical connection of casing sensor 470 with analog to digital board 460.

Figure 14:
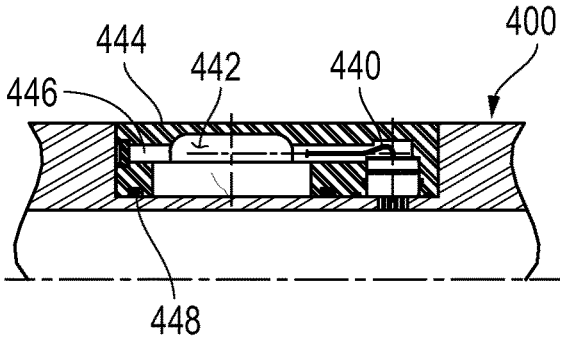
FIG. 14 is a side cross-sectional view of the tubing sensor chamber of the sensor section of the tool.

FIG. 14 is a side cross-sectional view of a tubing sensor chamber 442 of sensor section 400 of tool 10. A tubing sensor 440 is located inside sensor chamber 442, in communication with annulus between the production tubing and tool 10. In this position, tubing sensor 440 can measure environmental conditions such as pressure of the production zone flow inside tool 10. Chamber 442 has a cover 444 that is sealed by seal 448, thereby providing an environmentally protective enclosure of chamber 442. An electrical passage 446 connects chamber 440 with chamber 462 to provide a path for electrical connection of tubing sensor 440 with analog to digital board 460.

As described herein above, the unique and novel features of tool 10 provide the beneficial ability to electronically connect electronic devices located in separate tool sections with a continuous electrical connector without the use of exposed plug connectors. Further, the unique and novel features of tool 10 provide the beneficial ability of maintaining an atmospheric pressure condition within tool 10 across several tool section connections 500, where external conditions down hole include extreme pressures.

Operation

References to section names, such as "upper" and "lower" or "computer," "valve," or "sensor," are merely for convenience and not intended to completely describe, require, or limit the contents of any section of tool 10, and as used here, do not. It is known that the beginnings and ends of the sections may be variously located to include or exclude certain equipment. It is also known that certain teachings of the present invention can be applied to other subterranean tools besides a comingler.

Unique to the present inventions, among other aspects, is the non-threaded, and non-rotated coupling of contiguous sections 200, 300 and 400. Connection system 500 may be described as a linear key-slot connection. Such connections 500 are not known to have been used previously in the connection of tubulars for subterranean production. Computer section 200 is connected to valve assembly 300 by key-slot connection 500. Similarly, valve assembly 300 is connected to sensor assembly 400 by key-slot connection 500.

As seen in FIG. 2, top sub 100 comprises a tubular having a threaded pin connection 102 for connection to a production string component 20, such as a submersible pump. Top sub 100 has a hollow center 104. The submersible pump has electrical power supplied to it. Power wiring from the submersible pump is connected to electrical connector 230 in top sub 100 to power tool 10. Electrical connector 230 is sealed in place inside hollow center 104 of top sub 100 by a bushing 232.

Bushing 232 seals chamber 240 in computer section 200 from the environmental pressure on the other side of bushing 232. Key-slot connection 500 is fully detailed above, and only selected features are further detailed here. As described above, contiguous sections of tool 10 can be combined with a male flange 510 and a female flange 520. They can also be combined as in FIG. 5, with abutting female flanges 520A and 520B over an internal male flange 510.

Dowels 570 serve to align the internal grooves 512 and external grooves 522 to form keyways 516. Dowels 570 sections also serve to prevent relative rotation between the connecting sections of tool 10.

As seen in FIG. 3, keys 540 must slip into access relief 532. Excessively large or excessively small keys 540 are undesirable, as they become difficult and time consuming to assemble, and lack body strength to accept fastener 530, or support the tensile loads between the sections of tool 10. To strike a balance between access and function, the preferred number of keys is between about 8 and 11, although a few more or less can be conveniently used.

Set screws 582 are located in threaded holes 580 and intersect receiving grooves 584 to axially bias the load between the connecting sections of tool 10 (such as computer section 200 and gear insert 280) such that keys 540 support the primary tensile load between the connecting sections of tool 10.

As illustrated in FIG. 5, seals 562 can be located in seal grooves 560 to create a sealed relationship between male flange 510 and female flanges 520A and 520B. Dowels 570, set screws 582 intersecting receiving grooves 584, and seals 562 can be combined with the system of keys 540 in keyways 516 to form a more durable, linear, non-rotated, key-slot connection system 500. It will be understood by a person of ordinary skill in the art that individual components of this system can be modified or substituted without departing from the teaching, suggestion, spirit, and scope of the invention. For example, receiving grooves may be replaced with drill points, or simply not included.

A fundamental advantage of the use of key-slot connection 500 is that it enables tool 10 to incorporate a system of environmentally controlled electronic passages (250, 350, 450) and chambers (240, 442, 462, 472) connected by secondary passages (446, 466, 476). By use of key-slot connection 500, the interconnected chamber and passage system (collectively "600") can be created as between multiple sections (e.g., 200, 300, 400). In particular, it is both unconventional and challenging to provide small diameter electronic passages such as 250, 350, and 450 in the cylinder wall portion of a tubular body section of a subterranean tool. Referring FIG. 3, electrical passage 590 extends laterally through ungrooved portion 524 of female connector 520 of key-slot connection 500.

As seen in FIG. 11, a seal, such as spool seal 390 is inserted in spool bores 352. Spool seal 390 provides a sealed connection between the electrical passages (e.g., 250 and 350; 350 and 450) in contiguous sections 200, 300 and 400. As a result, the environmental conditions inside interconnected chamber and passage system 600 is protected.

Referring to FIG. 7, circuit board 242 receives electrical power through electrical connector 230 in top sub 100 (FIG. 2). The submersible pump is the source of the electrical power. Circuit board 242 can send and receive data to the surface, through wiring connected to electrical connection 230. Electrical connection 230 may be four wire connections and may include a fifth wire for ground. Additional connections may be provided. As stated above. circuit board 242 includes a computer or processor as necessary to operate tool 10.

Circuit board 242 provides power through wiring in secondary passage 244 to connector 246 which is sealed to the body of computer section 200 to maintain the environmental integrity of chamber and passage system 600. Electrical connector 246 provides the connection for power to motor 260 for rotating valve 370.

Gearbox 262 converts the speed of motor 260 into torque. A harmonic drive 264 may be connected to gearbox 262 to further convert the speed of motor 260 into torque, transmitted through shaft 362 to operate valve 370. Resolver 360 is electrically connected to circuit board 242 through electrical passage 350 and electrical passage 250. Resolver 360 determines the position of shaft 362 and thus the position of valve 370, and communicates this information to circuit board 242.

The lower end of tool 10 is connected to a packer set between the upper and lower producing zones. Tool 10 has an inlet orifice 402 near the lower end of tool 10, for receiving a fluid from the lower producing zone into the inside 404 of sensor section 400. Tubular sensor 440 obtains pressure and temperature data from the lower zone fluid inside tool 10, and transmits the data to analog to digital board 460. Casing sensor 470 obtains pressure and temperature data from the production fluid outside tool 10, and transmits the data to analog to digital board 460. Analog to digital board 460 converts the analog readings from the sensors and transmits the data to circuit board 242, which transmits the information to the surface.

An outlet port 306 extends through the cylindrical wall of sensor section 400, adjacent to valve 370. Valve 370 has a vented portal 372. By instructions from the surface to circuit board 242, valve 370 is controllably rotatable between an open position in which vented portal 372 is aligned with the outlet port 306 so that lower zone fluid inside tool 10 may flow through outlet port 306. Lower zone fluid flowing through outlet port 306 is thus comingled with the upper zone fluid and pumped together by the submersible pump.

When valve 370 is rotated to a closed position, vented portal 372 is not aligned with outlet port 306, and the flow of lower zone production fluid through outlet port 306 is blocked by valve 370. In the preferred embodiment, valve 370 valve is positionable to select any desired degree of alignment between the vented portal 372 with outlet port 306 to selectively control the rate of flow of lower zone fluid to be comingled with the upper zone fluid.

A computer or processor on circuit board 242 can be used to control the amount of opening and closing of valve 370, based on instructions from the surface, or based on a preprogrammed algorithm that responds to data from sensors 440, 470, or other input. Advantageous to the present invention is the ability to open valve 370 in any partially rotated amount. This provides tool 10 with the desirable ability to fully control the amount of fluid flow from the lower reservoir that is comingling with the production of the upper reservoir.

As described herein above, the unique and novel features of tool 10 provide the beneficial ability to electronically connect electronic devices located in separate tool sections with a continuous electrical connector without the use of exposed plug connectors. Further, the unique and novel features of tool 10 provide the beneficial ability of maintaining an atmospheric pressure condition within tool 10 across several tool section connections 500, where external conditions downhole include extreme pressures.

Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is contemplated that the appended claims will cover any such modifications or embodiments that fall within the true scope of the invention.

The invention claimed is:

1. A subterranean reservoir comingling tool, comprising:
- a hollow tubular body having a cylindrical wall;
- the body comprising a plurality of sections;
- the plurality of sections connected by non-threaded linear connections;
- an electrical passage located within the cylinder wall of contiguous sections, located in lengthwise orientation;
- a seal located in the electrical passage at a juncture between contiguous sections;
- the plurality of sections collectively comprising:
  - a circuit board having a computer processor;
  - an electric motor, electrically connected to the circuit board;
  - a gearbox connected to the motor;
- a shaft extending from the gearbox;
- the tool having an inlet orifice at one end for receiving a first fluid into the tool;
- an outlet port perforating the cylindrical wall of the tubular body;
- a rotatable valve connected to the shaft, and having a vented portal; and,
- the valve being controllably rotatable between an open position in which the vented portal is aligned with the outlet port and fluid inside the tool flows through the outlet, and a closed position in which the vented portal is not aligned with the outlet and flow through the outlet is blocked.

2. The tool of claim 1, further comprising:

the valve being positionable to select the degree of alignment between the vented portal with the outlet port to control the rate of flow of fluid from the inlet of the tool to the outlet of the tool.

3. The tool of claim 1, further comprising:

a harmonic drive connected to the gearbox.

4. The tool of claim 1, further comprising:

a pressure sensor located inside the tool in a chamber connected to the electrical passage;

an analog to digital converter located inside the tool in a chamber connected to the electrical passage, and being electrically connected to the sensor;

the analog to digital converter electrically connected to the circuit board; and, the sensor and analog to digital converter maintain an atmospheric pressure within the chambers when the tool is operating in a subterranean environment.

5. The tool of claim 1, further comprising:

a data wire located in the electrical passage and extending between sections; and, an electrical power supply wire located in the electrical passage and extending between sections.

6. The tool of claim 1, further comprising:

a condition monitoring instrument located inside a second section of the plurality of sections and being electrically connected to the data wire through the second portal.

7. The tool of claim 6, further comprising:

the condition monitoring instrument being a resolver connected to the shaft;

the resolver electrically connected to the circuit board; and, wherein the resolver relays data regarding the position of the valve to the circuit board.

8. The comingler apparatus of claim 1 wherein the circuit board comprises a processor, a memory, and a power source.

* * * * *